United States Patent [19]

Friihauf et al.

[11] 4,080,303

[45] Mar. 21, 1978

[54] LUBRICANT COMPOSITIONS CONTAINING BORON DISPERSANT, VI IMPROVER, AND AROMATIC CARBOXYLIC ACID ESTERS

[75] Inventors: Edward Joe Friihauf; Donald Leon Murfin, both of Mentor, Ohio

[73] Assignee: The Lubrizol Corporation, Wickliffe, Ohio

[21] Appl. No.: 490,473

[22] Filed: Jul. 22, 1974

[51] Int. Cl.[2] ..... C10M 1/32; C10M 1/10; C10M 1/24; C10M 3/26

[52] U.S. Cl. ..... 252/34.7; 252/49.6; 252/51.5 A; 252/57; 252/78.1

[58] Field of Search ..... 252/49.6, 51.5 A, 56 S, 252/78, 57, 34, 34.7

[56] References Cited

U.S. PATENT DOCUMENTS

| | | | |
|---|---|---|---|
| 2,936,320 | 5/1960 | Benoit | 252/57 |
| 3,019,188 | 1/1962 | Craven et al. | 252/57 |
| 3,021,357 | 2/1962 | Swakon | 252/57 |
| 3,087,936 | 4/1963 | Le Suer | 252/49.6 |
| 3,533,945 | 10/1970 | Vogel | 252/49.6 |
| 3,634,249 | 1/1972 | Dupas et al. | 252/59 |
| 3,637,501 | 1/1972 | Malec et al. | 252/57 |
| 3,658,836 | 4/1972 | Vineyard | 252/49.6 |
| 3,702,300 | 11/1972 | Coleman | 252/51.5 A |
| 3,825,496 | 7/1974 | Braid | 252/47.5 |
| 3,974,081 | 8/1976 | Rutkowski et al. | 252/79 |

*Primary Examiner*—Delbert E. Gantz
*Assistant Examiner*—Irving Vaughn
*Attorney, Agent, or Firm*—James W. Adams, Jr.; Daniel N. Hall

[57] ABSTRACT

Lubricant compositions comprising (I), a viscosity improving agent, (II) a boron-containing dispersant, and (III) an ester of an aromatic carboxylic acid having six to ten carbon atoms in the aromatic nucleus and a total of 6 to 40 aliphatic and alicyclic carbon atoms as well as additive concentrates for making such lubricant compositions are disclosed. Preferably, (I) is a carboxy-containing interpolymer in which some carboxy radicals are esterified and the remaining carboxy radicals are neutralized with an amino compound and (II) is a borated, acylated polyamino compound, having an acyl group containing at least 50 carbon atoms. These lubricant compositions are useful as automatic transmission fluids and the like.

8 Claims, No Drawings

LUBRICANT COMPOSITIONS CONTAINING BORON DISPERSANT, VI IMPROVER, AND AROMATIC CARBOXYLIC ACID ESTERS

FIELD OF THE INVENTION

This invention relates to lubricant compositions containing (I) a viscosity improving agent, (II) a boron-containing dispersant, and (III) an ester of an aromatic carboxylic acid. It further relates to additive concentrates for formulating such lubricant compositions.

BACKGROUND OF THE INVENTION

Formulation of lubricant compositions has become an increasingly complex art as the result of interacting social and economic factors. The rising cost of lubricant raw materials in the face of increasing consumption has made it more and more desirable to have formulations which exhibit longer service life than has been previously found. Furthermore, changes in automobile design and driving patterns have resulted in more severe service conditions for various types of lubricants. For example, lubricants used in automotive and truck manual and automatic transmissions have been subjected to more severe conditions because of increased stop- and go-type driving and changes in transmission designs which make operating temperatures higher and heat dispersal more difficult. Therefore, there has been a continuing and increasing demand for new, improved lubricant formulations. Lubricant compositions of the present invention in part help meet this demand. They are useful primarily as automatic and manual transmission fluids, hydraulic fluids, hydrostatic transmission fluids, transaxle fluids, power steering pump fluids and hypoid gear lubricants.

DESCRIPTION OF THE PRIOR ART

U.S. Pat. No. 3,087,936 discloses boron- and nitrogen-containing dispersant compositions which are prepared by borating an acylated polyamine having an acyl group of at last 50 carbon atoms. U.S. Pat. No. 3,702,300 discloses the carboxy-containing interpolymers in which some of the carboxy radicals are esterified and the remaining carboxy radicals are neutralized by reaction with a polyamino compound. This interpolymer is especially effective as a viscosity improving agent. U.S. Pat. No. 2,936,320 discloses diesters of mixed aromatic dibasic acids. U.S. Pat. Nos. 3,019,188 and 2,936,320 disclose the use of esters of aromatic carboxylic acids as synthetic oils. U.S. Pat. Nos. 3,236,770 and 3,489,682 disclose certain transmission fluids containing nitrogen-containing dispersants, while U.S. Pat. Nos. 3,344,074; 3,498,920; 3,663,437 and 3,755,166 disclose certain organic seal swelling agents.

SUMMARY OF THE INVENTION

Lubricant compositions of the present invention comprise a major amount of oil, and (I) about 0.3 to about 4% of at least one viscosity improving agent;

(II) about 0.1 to about 2% of at least one boron-containing dispersant; and (III) about 1 to about 10% of at least one ester of at least one aromatic carboxylic acid of the formula:

$$R_m(Ar)(COOH)_n, \qquad \text{Formula I}$$

wherein $m$ is 0 to 7, $n$ is 1 to 6, Ar is an aromatic nucleus of 6 to 10 carbon atoms, R is a hyddrocarbon-based group of up to about 40 carbon atoms and at least one alcohol of the formula:

$$R'(OH)_s \qquad \text{Formula II}$$

wherein $s$ is 1 to 6 and R′ is a hydrocarbon-based group of up to 40 carbon atoms, with the proviso that the total number of aliphatic and alicyclic carbon atoms in both R and R′ is at least 6.

The concentrate compositions of the present invention, which can be blended with oil to produce the hereinbefore described lubricant compositions, comprise (I) about 2 to 73% of at least one viscosity improving agent; (II) about 0.6 to about 60% of at least one boron-containing dispersant; and (III) about 14 to about 96% of at least one ester of at least one aromatic carboxylic acid, as hereinbefore defined.

Preferably, the lubricant compositions of this invention comprise a minimum of about 0.7% (I), a maximum of about 2% (I); a minimum of about 0.5% (II), and a maximum of about 1% (II); a minimum of about 1% (III), and a maximum of about 7% (III). The concentrate compositions preferably contain a minimum of about 8% (I), a maximum of about 60% (I); a minimum of about 5% (II), a maximum of about 40% (II); and a minimum of about 25% (III), and a maximum of about 85% (III). The balance of the concentrate composition may include one or more liquid diluent/solvents and other additives as hereinafter described while the balance of the lubricant compositions may contain, in addition to one or more base oils as hereinafter described, other additives as hereinafter described. In this specification and the appended claims all percentages are by weight of the total composition unless expressly stated otherwise and all parts are parts by weight.

DETAILED DESCRIPTION OF THE INVENTION (I) The viscosity improving agent.

A number of viscosity improving agents are known to those of skill in the art. Typically these agents function as viscosity index (V.I.) improvers by reducing the extent of an oil's viscosity change as a result of temperature change. A number of discussions of such materials have appeared. See, for example, M. W. Ranney, "Lubricant Additives" Noyes Data Corporation, Parkridge, New Jersey, U.S.A., and London, England, (1973), pages 93–136, as well as "Lubricant Additives," by Smalheer and Smith, Lezius-Hiles Company, Cleveland, Ohio, (1967), pages 7–8. A number of viscosity improving agents have also been disclosed in patents. Typical of these are the following:

| U.S. PAT. | VI IMPROVER TYPE |
|---|---|
| 3,637,503 | alpha-olefin polymers |
| 3,634,249 | ethylene/propylene copolymers |
| 2,099,513 | isobutene polymers |
| 3,380,928 | isobutene polymers |
| 3,344,067 | isobutene interpolymers |
| 3,329,613 | butadiene polymers |
| 2,534,095 | butadiene polymers |
| 3,389,087 | ethylene/olefin interpolymers |
| 3,320,168 | 4-methyl-1-pentene interpolymers |
| 2,478,843 | cyclohexyl-styrene interpolymers |

These patents are incorporated by reference herein for their disclosures relevant to viscosity improving agents.

Especially preferred viscosity improving agents for use in the lubricant and concentrate compositions of the present invention are nitrogen-containing mixed esters of carboxy-containing interpolymers having a reduced specific viscosity of from about 0.05 to about 2. These esters are substantially free of titratable acidity and characterized by the presence within their polymeric structures of at least one of these pendant polar groups; (A) a relatively high molecular weight carboxylic ester group having at least 8 aliphatic carbon atoms in the ester radical, (B) a relatively low molecular weight carboxylic ester group having no more than 7 aliphatic carbon atoms in the ester radical, and (C) a carbonyl-polyamino group derived from a polyamino compound having one primary or secondary amino group, wherein the molar ratio of (A):(B):(C) is (60–90): (10–30):(2–15).

An essential element of these sterified interpolymers is that they are mixed esters, i.e., ones in which there is the combined presence of both a high molecular weight ester group and a low molecular weight ester group, particularly in the ratios as stated above. Such combined presence is critical to the viscosity properties of the mixed ester, both from the standpoint of its viscosity index improving characteristics and from the standpoint of its thickening effect upon lubricating compositions in which it is used as an additive.

In reference to these esterified, amine-treated interpolymers, it should be noted that an ester radical is represented structurally as —C(O)OR″ and that the number of carbon atoms in an ester radical is thus the combined total of the carbon atom in the carbonyl group and the carbon atoms in the ester group, i.e., the —OR″ group.

Another essential feature of these preferred viscosity improving agents is the presence of a polyamino group derived from a particular polyamino compound, i.e., one in which there is one primary or secondary amino group. Such polyamino group, when present in the mixed ester in the proportion as stated above, not only enhances the anti-sludge properties but also achieves the desired balance of the solubility characteristics in relation to the ester groups pesent therein.

Still another essential feature of these preferred viscosity improving agents is the extent of esterification in relation to the extent of neutralization of the unesterified carboxy groups of the carboxy-containing interpolymer through the conversion thereof to polyamino-containing groups. For convenience, the relative proportions of the high molecular weight ester group to the low molecular weight ester group and to the polyamino group are expressed in terms of molar ratios of (60–90):(10–30 ):(2–15), respectively, as is noted above. The preferred ratios are (70–80):(15–25):(5). It should be noted that the linkage described hereinbefore as the carbonyl-polyamino group may be amide, imide, or amidine, and inasmuch as any such linkage can be present in these viscosity improving agents, the term "carbonyl-polyamino" is thought to be a convenient, generic expression useful for the purpose of defining this concept.

A further important element of these preferred viscosity improving agents is the molecular weight of the carboxy-containing interpolymer. For convenience, the molecular weight is expressed in terms of the "reduced specific viscosity" of the interpolymer which is a widely recognized means of expressing the molecular size of a polymeric substance. As used herein, the reduced specific viscosity (abbreviated as RSV) is the value obtained in accordance with the formula:

$$RSV = (\text{Relative Viscosity}-1)/(\text{Concentration})$$

wherein the relative viscosity is determined by measuring, by means of a dilution viscometer, the viscosity of a solution of one gram of the interpolymer in 100 ml. of acetone and the viscosity of acetone at 30° ± 0.02° C. For purpose of computation by the above formula, the concentration is adjusted to 0.4 gram of the interpolymer per 100 ml. of acetone. A more detailed discussion of the reduced specific viscosity, also known as the specific viscosity, as well as its relationship to the average molecular weight of an interpolymer, appears in Paul J. Flory, Principles of Polymer Chemistry (1953 Edition) pages 308 et seq.

While viscosity improving interpolymers having a reduced specific viscosity of from about 0.05 to about 2 are useful in the compositions of this invention, the preferred interpolymers are those having a reduced specific viscosity of from about 0.3 to about 1. In most instances, interpolymers having a reduced specific viscosity of from about 0.5 to about 1 are particularly useful.

Especially preferred interpolymers useful as the viscosity improving agent (I) are those of a $C_{2-4}$ $\alpha$-olefin or styrene and an $\alpha$, $\beta$-unsaturated aliphatic acid anhydride or ester thereof.

The particularly preferred viscosity improving agents (I) for use in the present invention are the hereinbefore described esterified-amine treated interpolymers wherein the interpolymer is made from equimolar proportions of styrene and maleic anhydride which is treated with high and low molecular weight alkanols of appropriate size (preferrably containing 8–24 and 3–5 carbon atoms, respectively) and polyamino compounds having one primary or secondary amino group and at least one monofunctional amino group such as a tertiary-amino or heterocyclic amino group, such as N,N-dialkyl alkylene polyamines of 2 to 10 nitrogens and amino-alkyl-substituted morpholines. Especially preferred polyamino compounds include ethylene and propylene polyamines and N-aminoethyl and propyl morpholines.

Further detailed discussion of these interpolymers and methods for preparing and using them are described in detail in U.S. Pat. No. 3,702,300, which is hereby incorporated by reference for its disclosures regarding viscosity improving agents.

(II) The boron-containing dispersant.

Boron-containing dispersants have been disclosed in the prior art as being useful in lubricant compositions such as those of the present invention. See, for example, the following U.S. Patents:

| U.S. PAT. | DISPERSANT TYPE |
|---|---|
| 2,216,618 | borated, acylated polyamines |
| 3,000,916 | borated amino-phenol-formaldehyde condensates |
| 3,254,025 | borated amino-phenol-formaldehyde condensates |
| 3,658,836 | borated amino-phenol-formaldehyde condensates |
| 3,666,662 | borated amino-phenol-formaldehyde condensates |
| 3,344,069 | borated acylated polyamines |
| 3,449,362 | borated acylated polyamines |
| 3,281,428 | borated acylated polyamines |
| 3,306,908 | borated acylated polyamines |
| 3,313,727 | borated acylated polyamines |

-continued

| U.S. PAT. | DISPERSANT TYPE |
|---|---|
| 3,491,025 | borated acylated polyamines |
| 3,533,945 | borated high molecular weight carboxylate esters |

These patents are hereby incorporated by reference for their disclosures regarding boron-containing dispersants.

Preferred boron-containing dispersants for use in the lubricant and concentrate composition for the present invention are those described in U.S. Pat. No. 3,087,936, which is hereby incorporated by reference for its relevant disclosures. These dispersants are oil-soluble, nitrogen- and boron-containing compositions obtained by treating an acylated nitrogen composition characterized by the presence within its structure of (A) a substantially hydrocarbon-substituted succinic radical selected from the class consisting of succinoyl, succinimidoyl, and succinoyloxy radicals wherein the substantially hydrocarbon substituent contains at least about 50 aliphatic carbon atoms and (B) a nitrogen-containing group characterized by a nitrogen atoms attached directly to said succinic radical, with a boron compound selected from the class consisting of boron oxide, boron halides, boron acids, and esters of boron acids in an amount to provide from about 0.1 atomic proportion of boron for each mole of said acylated nitrogen composition to about 10 atomic proportions of boron for each atomic proportion of nitrogen of said acylated nitrogen composition.

Particularly preferred boron-containing dispersants are prepared by forming an acylated nitrogen intermediate by the reaction at a temperature within the range of from about 80° to about 250° C., of a substantially aliphatic olefin polymer-substituted succinic acid-producing compound having at least about 50 aliphatic carbon atoms in the polymer substituent with at least about one-half equivalent of an amine, for each equivalent of the acid-producing compound used, selected from the class consisting of alkylene amines and hydroxy-substituted alkylene amines, and reacting, at a temperature between about 5° and about 250° C., said acylated nitrogen intermediate with a boron compound selected from the class consisting of boron oxide, boron halide, boron acids, and esters of boron acids in an amount to provide a boron content as specified hereinabove.

Within this particularly preferred subgenue of boron-containing dispersants are the especially preferred dispersants wherein the hydrocarbon substituents of (A) is of a polyisobutene having a number average molecular weight of about 700 to about 5,000 as determined by vapor phase osmometry.

For further detailed discussions of the nature and preparation of such preferred boron- and nitrogen-containing dispersants, see U.S. Pat. No. 3,087,936, which is hereby incorporated by reference for its disclosures in this regard.

(III) The aromatic carboxylic acid esters.

The third component of the lubricant and concentrate compositions of the present invention (III) is an ester of an aromatic carboxylic acid of the generic formula $$R_m\text{-}(Ar)\text{-}(COOH)_n \qquad \text{Formula I}$$

and a mono- or polyhydric alcohol of the formula $$R'(OH)_s \qquad \text{Formula II}$$

wherein *m, n, s,* R, Ar and R′ are as defined hereinbefore. Preferably *m* is 0 to 2, *n* is 2 to 4, *s* is 1 to 2 (more preferably *n* is 1 and *s* is 1), Ar is a phenyl or naphthyl nucleus of the valence, *m* and *n,* and R and R′ are each independently aliphatic or alicyclic (more preferably alkyl, alkenyl, cycloalkyl or cycloalkenyl groups of up to about 20 carbon atoms) with the proviso that preferably the number of carbon atoms in R and R′ total at least 12. Even more preferably $R'(OH)_s$ is a straight chain mono-hydric alkanol of up to 20 carbon atoms.

In the fullest scope of this invention the R and R′ groups are hydrocarbon-based groups. As used herein, the term "hydrocarbon-based group" denotes a group having a preponderance of carbon and hydrogen atoms and having predominantly hydrocarbon character in the context of this invention. Such groups include the following:

(1) Hydrocarbon groups; that is aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such hydrocarbon groups are well known to those skilled in the art; examples include methyl, ethyl, propyl, isopropyl, butyl (normal, iso and tertiary), $C_5H_{11}$ (all isomers), $C_6H_{13}$ (all isomers), $C_8H_{17}$ (all isomers), $C_{12}H_{25}$ (all isomers), etc. to $C_{40}H_{81}$, cyclohexyl, methylcyclohexyl (all isomers), cyclopentyl, ethyl cyclopentyl, decalinly, phenyl, tolyl, xylyl, benzyl, beta-phenyl ethyl, gamma propyl phenyl, etc. Ethylenically unsaturated analogs of these groups can also be present provided there is no more than one carbon-to-carbon ethylenic bond for every ten carbon-to-carbon single bonds in the group.

(2) Groups which, while predominantly hydrocarbon in character within the context of this invention, contain atoms other than hydrogen and carbon or substituents composed of such atoms and sometimes of carbon and hydrogen as well. Such atoms and substituents may be pendant to the main chain or enchained in it. The presence of these atoms and substituents does not alter the predominantly hydrocarbon character of the group. Those skilled in the art will be aware of suitable hetero atoms and substituents. Illustrative of such substituents are the following:

pendant ether groups (especially hydrocarbyloxy and particularly alkoxy groups of up to ten carbon atoms)

enchained oxa linkages (e.g., —0— linkages in a hydrocarbyl chain)

nitro cyano fluoro aromatic chlorine (i.e., chlorine bonded to a carbon of an aromatic nucleus)

pendant thioether groups (especially $C_{1-10}$ alkyl thioethers such as methyl mercapto, butylmercapto, etc.)

enchained thia linkages (e.g., —S— linkages in the main hydrocarbyl chain)

pendant oxo groups (e.g., $CH_3\overset{O}{\overset{\|}{C}}-$ and $C_6H_5\overset{O}{\overset{\|}{C}}-$)

as well as enchained oxo function in the main chain (e.g., $-CH_2CH_2-\overset{O}{\overset{\|}{C}}-(CH_2)_4-CH_2-$)

pendant sulfonyl groups ($-SO_2-$) and enchained sulfonyl linkages pendant sulfinyl groups ($-SO-$) and enchained sulfinyl linkages etc., Other such non-hydrocarbyl atoms and substitutents will be apparent to those skilled in the art.

Preferably, the hydrocarbon-based group R is purely hydrocarbyl in nature. More preferably, it is not present, i.e., *m* in Formula I is zero, and the acid is a benzene or naphthalene-based carboxylic acid.

Illustrative aromatic carboxylic acids from which esters (III) of this invention can be derived are the following:

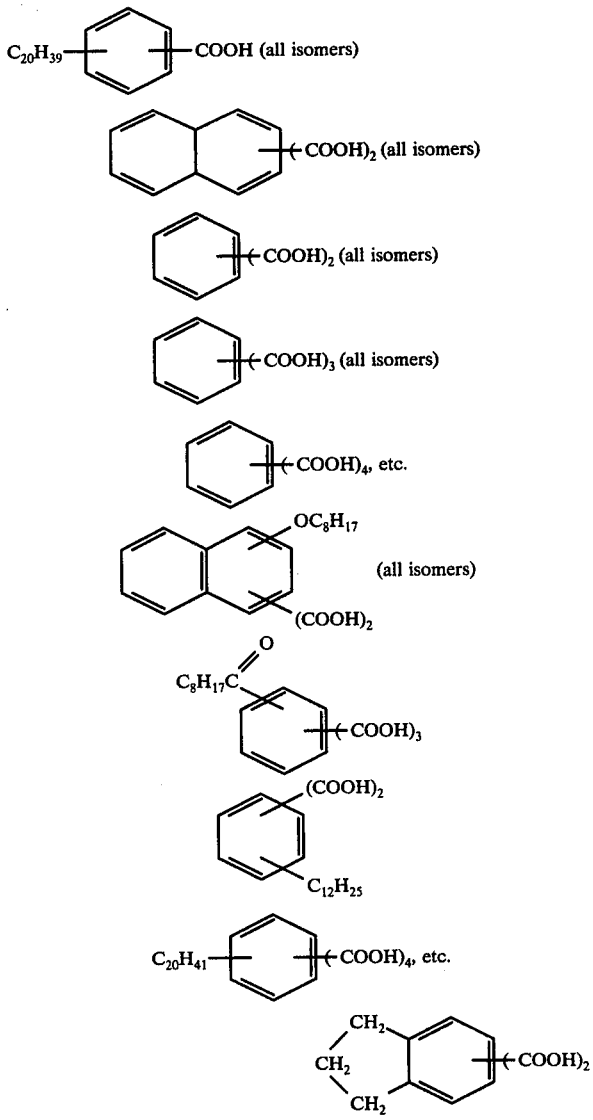

The esters (III) can be derived from mixtures of one or more of these acids.

Preferably the esters (III) for use in the compositions of this invention are derived from benzene and naphthalene carboxylic acids, more preferably they are benzene dicarboxylic acids such as phthalic, terphthalic and isophthalic acid.

The esters (III) used in the lubricant and concentrate compositions of the present invention are derived from the hereinbefore described aromatic carboxylic acids, and one or more mono- or polyhydric alcohols having up to six hydroxyl groups per molecule and of the formula:

$$R'(OH)_s$$

wherein R' is a hydrocarbon-based group of up to 40 carbon atoms and is of the same general nature as the R groups discussed above, with the exception that it is s-valent and can contain up to one ethylenic carbon-carbon bond per every carbon-carbon single bond. Exemplary monohydric alcohols R'OH are the following:

methanol
ethanol
n-propanol
isopropanol
allyl alcohol
butanols (primary, secondary and tertiary, etc.)
$C_5H_{10}OH$ (all isomers)
$C_{12}H_{25}OH$ (all isomers)
$C_{12}H_{23}OH$ (all isomers)
cyclopentanol
ethyl cyclopentanol (all isomers)
cyclohexanol
methyl cyclohexanol
cyclohexyl cyclohexanol
phenol
dodecenyl phenol
etc. up to $C_{40}H_{80}OH$ As noted above, straight chain alkanols of up to 20 carbon atoms are preferred, such as ethanol.

Typical polyhydric alcohols include alkylene glycols such as:

ethylene glycol
propylene glycol
trimethylene glycol
butylene glycol
polyglycols, such as diethylene glycol, triethylene glycol, tetraethylene glycol, dipropylene glycol, tripropylene glycol, dibutylene glycol, tributylene glycol, etc.

Other useful polyhydric alcohols include glycerol, monomethyl ether of glycerol, pentaerythritol, neopentyl glycol, trimethylol propane, the ethyl ester of 9,10-dihydroxy stearic acid, 1,2-propanediol, 1,4-propanediol, 2,3-hexanediol, 2,4-hexanediol, erythritol, 1,2-cyclohexanediol, 1,4-cyclohexanediol, 2-(hydroxyethyl)-1,4-cyclohexanediol, 1,4-dihydroxy-2-nitrodecane, etc.

Preferably, the alcohols used to produce the esters (III) of the present invention are monohydric aliphatic or alicyclic alcohols of up to 20 carbon atoms and contain no non-hydrocarbyl substituents. Primary monohydric alkanols of up to 20 carbons are among the more preferred alcohols.

The preparation of such aromatic carboxylic acid esters is well-known to those of skill in the art. A number of such techniques are disclosed in the following:

U.S. PATENTS 2,936,320
2,956,870
3,019,188
3,021,357
3,637,501

These patents are hereby incorporated by reference for their disclosures relevant to the production of aromatic carboxylic acid esters.

Generally, it is preferable that one equivalent aromatic acid and one equivalent of alcohol be used to form ester (III) for use in the compositions of this invention (an equivalent of acid or its molecular weight divided by the number of reactive-carboxyl groups and an equivalent of an alcohol is similarly calculated from the number of hydroxyl groups present. For example, phthalic acid (or anhydride) has two equivalents per mole, ethanol one equivalent per mole and 4-(2-hydroxyethyl) phenol two equivalents per mole). It is possible, however, with polyhydric alcohols to use up to two or three equivalents of alcohol per equivalent of acid to form esters having unesterified hydroxyl groups.

As is well-known in the art, it is not necessary to use only free acids and alcohols to form esters; functional equivalents such as acid anhydrides, acid salts, acid halides, metal alcoholates, hydrocarbon halides, and the like can be used. Similarly, ester exchanges between esters of lower molecular weight alcohols and higher molecular weight alcohols can be advantageously used in certain circumstances.

The lubricant and concentrate compositions of this invention are prepared by conventional blending and mixing techniques well-known to those of skill in the art.

EXAMPLES

The following examples illustrate specific embodiments of the present invention; they are in no way intended to limit the scope of the invention which is defined by the appended claims.

MASTER BLEND

To make the following lubricant compositions a master blend is prepared containing 98 parts of a conventional mineral oil automatic transmission fluid base stock, 0.76 parts of a borated succinic acid-polyamide dispersant prepared in the manner described in U.S. Pat. No. 3,087,936 and 1.34 parts of an esterified/amine-treated styrene/maleic anhydride copolymer prepared in the manner disclosed in U.S. Pat. No. 3,702,300. Both these patents are incorporated by reference with regard to their disclosures of suitable methods for preparing these additives. To this blend is added 2 parts of the aromatic diesters listed in Table 1.

TABLE1

| EXAMPLE | AROMATIC ESTER |
|---|---|
| | Di(allyl)phthalate |
| 2 | Di(n-butyl)phthalate |
| 3 | Di(capryl)phthalate |
| 4 | Di(n-hexyl)terphthalate |
| 5 | Di(isononyl)isophthalate |
| 6 | Di(undecyl)phthalate |
| 7 | Di(octadecyl)1,8-naphthalene dicarboxylic acid |
| 8 | Di(ethylhexyl)phthalate |
| 9 | Isooctyl 4-tetrapropylbenzoate |

Each of the preparations made in Examples 1-9 exhibit seal swell properties appropriate for an automatic transmission fluid in laboratory tests.

EXAMPLE 10

An additive concentrate is prepared containing 25% of the viscosity improving agent used to prepare the master blend, 12.5% of the boron-containing dispersant used to prepare the master blend and 62.5% of di(n-hexyl)isophthalate. Eight parts of this concentrate is combined with 92 parts of paraffinic mineral oil to provide a lubricant composition.

The lubricant compositions of the present invention can be based on diverse oils of lubricating viscosity, including natural and synthetic lubricating oils and mixtures thereof. Preferably, these lubricating oil compositions have a minimum viscosity of about 44 SUS at 210° F.

They are use primarily as automatic transmission fluids, power steering pump fluids, transaxle lubricants, hypoid gear lubricants, hydraulic fluids and the like.

Natural oils include animal oils and vegetable oils (e.g., lard oil and castor oil) as well as liquid petroleum oils and solvent-treated or acid-treated oil, mineral oils of the paraffinic, naphthenic or mixed paraffinic naphthenic types. Paraffinic types are often preferred. Oils of the appropriate viscosity derived from coal or shale are also useful as base oils for the lubricant compositions of this invention. Synthetic oils include hydrocarbon oils, such as those formed by polymerization and interpolymerization of various olefins (e.g., polybutylenes, polypropylenes, propylene-isobutylene copolymers, poly(1-hexenes), poly(1-octenes), poly(1-decenes), etc. and mixtures thereof. Alkyl benzenes (e.g., dodecyl benzenes, tetradecyl benzenes, dinonyl benzenes, etc.); polyphenyl (e.g., biphenyl, terphenyls, alkylated polyphenyls, etc.), as well as alkylated diphenyl ethers and alkylated diphenyl sulfides and the derivatives, analogs and homologs thereof can also be used as base fluids.

Alkylene oxide polymers and interpolymers and derivatives thereof where the terminal hydroxyl groups have been modified by esterification, etherification, etc. constitute another class of known synthetic lubricating oils. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500-1000, diethyl ether of polypropylene glycol having a molecular weight of 1000-1500, etc.) or mono- and polycarboxylic esters thereof, for example, the acetic acid esters, mixed $C_3$-$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like. It should be noted that some of these synthetic ester oils are similar or the same as component (III) of the present invention and that their use may require the presence of an anti-seal-swelling agent.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, etc.

Still another type of ester useful in the lubricant compositions of this invention are hydrocarbyl phosphates, particularly triaryl phosphates, such as triphenyl phosphate, tricresylphosphate, etc.

Unrefined, refined and rerefined oils (and mixtures of each with each other) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Preferably the lubricant compositions of this invention containing a minimum of about 75% of one or more oil; more preferably, a minimum of 85% of one or more oil. Even more preferably they contain a minimum of 90% of one or more oil.

The additive concentrates of the present invention contain the components (I), (II), and (III) in the proportions hereinbefore set forth and can contain a solvent diluent which may be either an oil such as that described hereinbefore, or a more volatile organic solvent, such as benzene textile spirits, petroleum naphtha, mixed xylenes, toluene and the like which is not incompatible with the intended use of the ultimate lubricant formulation to be made from the concentrate.

Both the lubricant composition and concentrate composition of the present invention can contain in addition to the (I) viscosity improving agent, (II) boron-containing dispersant, and (III) aromatic carboxylic acid ester certain other additives which are commonly used in lubricants for the hereinabove recited purposes. These additives can be one or more of the following: oxidation inhibitors such as zinc dithiophosphates, hindered phenols, aromatic amines, sulfurized phenols; dispersants, such as high molecular weight alkyl succinimides, alkylthiophosphonates and the like; metal deactivators such as zinc dithiophosphates, organic sulfides, certain organic nitrogen compounds; anti-wear agents such as zinc dithiophosphates, organic phosphates and acid phosphates, organic sulfur compounds, sulfurized fats and amines; rust inhibitors, such as metal sulfonates, fatty acids and amines; corrosion inhibitors such as zinc dithiophosphates, metal phenols and phenates and basic metal sulfonates; foam inhibitors such as silicone polymers; and friction modifiers such as fatty acids and amides, lard oil, sperm oil, high molecular weight organic phosphorus acids and esters.

The use of these and other additives in automatic transmission fluids, hydraulic fluids and the like, is conventional in the art and those of skill in the art know the proportions in which they are to be used and can be formulated with the components (I), (II) and (III).

What is claimed is:

1. A lubricant composition comprising a major amount of oil and:

(I) about 0.3 to about 4% of at least one viscosity improving agent which is a nitrogen-containing mixed ester of carboxy-containing interpolymer having a reduced specific viscosity of from 0.05 to about 2, said ester being substantially free of titratable acidity, and being characterized by the presence within its polymeric structure of at least 1 of each of three pendant polar groups:

(A) a relatively high molecular weight carboxylic acid group having at least 8 aliphatic carbon atoms in the ester radical, (B) a relatively low molecular weight carboxylic acid ester group having no more than 7 aliphatic carbon atoms in the ester radical, and (C) a carbonyl-polyamino group derived from a polyamino compound having one primary or secondary amino group, wherein the molar ratio of (A):(B):(C) is (60–90):(-10–30):(2–15);

(II) about 0.1 to about 2% of at least one one boron-containing organic dispersant selected from the group consisting of borated, acylated polyamines, borated amino-phenolformaldehyde condensates and borated, high molecular weight carboxylate esters; and (III) about 1 to about 10% of at least one ester of (a) at least one aromatic carboxylic acid of the formula:

$$R_m(Ar)(COOH)_n$$

wherein $m$ is 0 to about 7, $n$ is 1 to about 6, Ar is an aromatic nucleus of about 6 to about 10 carbon atoms, R is a hydrocarbyl group of up to about 40 carbon atoms, and (b) at least one alcohol of the formula:

$$R'(OH)_s$$

wherein $s$ is 1 to about 6, R′ is a hydrocarbyl group of up to 40 carbon atoms, with the proviso that the total number of aliphatic and alicyclic carbon atoms in both R and R′ is at least about 6.

2. A lubricant composition as claimed in claim 1, wherein $m$ is zero, $n$ is 2 to 4, and $s$ is 1.

3. A lubricant composition as claimed in claim 2, wherein Ar is a benzene nucleus, $n$ is 2, and R′ is an aliphatic or alicyclic hydrocarbon group of up to about 20 carbon atoms.

4. A lubricant composition as claimed in claim 1, wherein the boron-containing dispersant (II) is obtained by treating an acylated nitrogen composition characterized by the presence within its structure of:

(A) a substantially hydrocarbon-substituted succinic acid radical selected from a class consisting of succinoyl, succinimidoyl and succinoyloxy radicals, wherein the substantially hydrocarbon substituent contains at least about 50 aliphatic carbon atoms, and (B) a nitrogen-containing group characterized by the nitrogen atom attached directly to said succinic radical, with a boron compound selected from a class consisting of boron oxide, boron halide, boron acids and esters of boron acids in an amount to provide from about 0.1 atomic proportion of boron for each mole of said acylated nitrogen composition to about 10 atomic proportions of boron for each atomic proportion of nitrogen of said acylated nitrogen composition.

5. A concentrate for formulating lubricant compositions useful as automatic and manual transmission fluids, power steering pump fluids, hydraulic fluids, and transaxle lubricants, which comprises (I) about 2% to 73% of at least one viscosity improving agent which is a nitrogen-containing mixed ester of a carboxy-containing interpolymer having a reduced specific viscosity of from 0.05 to about 2, said ester being substantially free of titratable acidity, and being characterized by the presence within its polymeric structure of at least 1 of each of three pendant polar groups:

(A) a relatively high molecular weight carboxylic acid group having at least 8 aliphatic carbon atoms in the ester radical, (B) a relatively low molecular weight carboxylic acid ester group having no more than 7 aliphatic carbon atoms in the ester radical, and (C) a carbonyl-polyamino group derived from a polyamino compound having one primary or secondary amino group, wherein the molar ratio of (A):(B):(C) is (60–90):(-10–30):(2–15);

(II) about 0.6 to about 60% of at least one boron-containing organic dispersant selected from the group consisting of borated, acylated polyamines, borated amino-phenolformaldehyde condensates and borated, high molecular weight carboxylate esters; nd (III) about 1 to about 10% of at least one ester of (a) at least one aromatic carboxylic acid of the formula:

$$R_m(Ar)(COOH)_n$$

wherein $m$ is 0 to about 7, $n$ is 1 to about 6, Ar is an aromatic nucleus of about 6 to about 10 carbon atoms, R is a hydrocarbyl group of up to about 40 carbon atoms, and (b) at least one alcohol of the formula:

$$R'(OH)_s$$

wherein $s$ is 1 to about 6, and R′ is a hydrocarbyl group of up to 40 carbon atoms, with the proviso that the total number of aliphatic and alicyclic carbon atoms in both R and R′ is at least about 6.

6. A concentrate as claimed in claim 5, wherein $m$ is zero, $n$ is 2 to 4 and $s$ is 1.

7. A concentrate as claimed in claim 6, wherein Ar is a benzene nucleus, $n$ is 2 and R′ is an aliphatic or alicyclic hydrocarbon group of up to about 20 carbon atoms.

8. A concentrate as claimed in claim 5, wherein the boron-containing dispersant (II) is obtained by treating an acylated nitrogen composition characterized by the presence within its structure of:

(A) a substantially hydrocarbon-substituted succinic acid radical selected from a class consisting of succinoyl, succinimidoyl and succinoyloxy radicals, wherein the substantially hydrocarbon substituent contains at least about 50 aliphatic carbon atoms, and (B) a nitrogen-containing group characterized by the nitrogen atom attached directly to said succinic radical, with a boron compound selected from a class consisting of boron oxide, boron halide, boron acids and esters of boron acids in an amount to provide from about 0.1 atomic proportion of boron for each mole of said acylated nitrogen composition to about 10 atomic proportions of boron for each atomic proportion of nitrogen of said acylated nitrogen composition.

* * * * *